US007054806B1

(12) United States Patent
Yamada

(10) Patent No.: US 7,054,806 B1
(45) **Date of Patent: *May 30, 2006**

(54) SPEECH SYNTHESIS APPARATUS USING PITCH MARKS, CONTROL METHOD THEREFOR, AND COMPUTER-READABLE MEMORY

(75) Inventor: Masayuki Yamada, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 530 days.

(21) Appl. No.: 09/262,852

(22) Filed: Mar. 5, 1999

(30) Foreign Application Priority Data

Mar. 9, 1998 (JP) ..... 10-057250

(51) Int. Cl.
*G10L 11/04* (2006.01)

(52) U.S. Cl. ..... 704/207; 704/258

(58) Field of Classification Search ..... 704/207, 704/258, 268

See application file for complete search history.

(56) References Cited

U.S. PATENT DOCUMENTS

| | | | | | |
|---|---|---|---|---|---|
| 5,479,564 | A | * | 12/1995 | Vogten et al. | 704/267 |
| 5,630,011 | A | * | 5/1997 | Lim et al. | 704/205 |
| 5,682,501 | A | * | 10/1997 | Sharman | 704/260 |
| 5,787,396 | A | | 7/1998 | Komori et al. | |
| 5,797,116 | A | | 8/1998 | Yamada et al. | |
| 5,864,812 | A | | 1/1999 | Kamai et al. | 704/268 |
| 5,884,253 | A | * | 3/1999 | Kleijn | 704/223 |
| 5,890,118 | A | * | 3/1999 | Kagoshima et al. | 704/265 |
| 6,125,344 | A | * | 9/2000 | Kang et al. | 704/207 |
| 6,169,240 | B1 | * | 1/2001 | Suzuki | 84/605 |

FOREIGN PATENT DOCUMENTS

| | | |
|---|---|---|
| EP | 0 696 026 | 2/1996 |
| EP | 0 703 565 | 3/1996 |
| JP | 59-68793 | 4/1984 |
| JP | 6-232762 | 8/1994 |
| JP | 8-160991 | 6/1996 |
| JP | 8-263090 | 10/1996 |

OTHER PUBLICATIONS

Gerson, et al., "Techniques for Improving The Performance of CELP–Type Speech Coders," IEEE Journal on Selected Areas in Communications, US, IEEE, Inc. vol. 10, No. 5, Jun. 10, 1992, pp. 858–865.

Kortekaas, et al., "Psychoacoustical Evaluation of the Pitch Synchronous Overlap and Add Speech–Waveform Manipulation Technique Using Single–Format Stimuli," Journal of the Acoustical Society of America, Apr. 1997, Acoust. Soc. America through AIP, vol. 101, No. 4, pp. 2202–2213.

* cited by examiner

*Primary Examiner*—W. R. Young
*Assistant Examiner*—Michael N. Opsasnick
(74) *Attorney, Agent, or Firm*—Fitzpatrick, Cella, Harper & Scinto

(57) ABSTRACT

The distance between the first two pitch marks of a voiced portion of speech data to be processed is calculated. The difference between the adjacent inter-pitch-mark distances is calculated. The respective calculation results are stored and managed in a file.

17 Claims, 7 Drawing Sheets

SPEECH SYNTHESIS APPARATUS USING PITCH MARKS, CONTROL METHOD THEREFOR, AND COMPUTER-READABLE MEMORY

BACKGROUND OF THE INVENTION

The present invention relates to a speech synthesis apparatus for performing speech synthesis by using pitch marks, a control method for the apparatus, and a computer-readable memory.

Conventionally, processing that synchronizes with pitches has been performed as speech analysis/synthesis processing and the like. For example, in a PSOLA (Pitch Synchronous OverLap Adding) speech synthesis method, synthetic speech is obtained by adding one-pitch speech waveform element pieces in synchronism with pitches.

In this scheme, information (pitch mark) about the position of each pitch must be recorded concurrently with the storage of speech waveform data.

In the prior art described above, however, the size of a file on which pitch marks are recorded becomes undesirably large.

SUMMARY OF THE INVENTION

The present invention has been made in consideration of the above problem, and has as its object to provide a speech synthesis apparatus capable of reducing the size of a file used to manage pitch marks, a control method therefor, and a computer-readable memory.

In order to achieve the above object, a speech synthesis apparatus according to the present invention has the following arrangement.

There is provided a speech synthesis apparatus for performing speech synthesis by using pitch marks, comprising:

first calculation means for calculating the distance between first two pitch marks of a voiced portion of speech data to be processed;

second calculation means for calculating the difference between adjacent inter-pitch-mark distances; and management means for storing the calculation results obtained by the first and second calculation means in a file and managing the results.

In order to achieve the above object, a speech synthesis apparatus according to the present invention has the following arrangement.

There is provided a speech synthesis apparatus for performing speech synthesis by using pitch marks, comprising:

first comparison means for, when a length of speech data to be processed is represented by d, and a maximum value dmax and a minimum value dmin are defined for a predetermined word length, comparing the length d with the maximum value dmax;

second comparison means for comparing the length d with the minimum value dmin on the basis of the comparison result obtained by the first comparing means;

subtraction means for subtracting the maximum value dmax or the minimum value dmin from the length d on the basis of the comparison results obtained by the first and second comparison means; and management means for storing the difference obtained by the subtraction means or the length d in the file and managing the difference or the length on the basis of the comparison results obtained by the first and second comparison means.

In order to achieve the above object, a speech synthesis apparatus according to the present invention has the following arrangement.

There is provided a speech synthesis apparatus for performing speech synthesis by using pitch marks, comprising:

storage means for storing a file for, managing the distance between first two pitch marks of a voiced portion of speech data to be processed and the difference between adjacent inter-pitch-mark distances;

first loading means for loading the distance between the first two pitch marks of the voiced portion;

second loading means for loading the difference between the adjacent inter-pitch-mark distances; and calculation means for calculating the next pitch mark position from a pitch mark position calculated immediately before the calculation, the pitch mark distance to an adjacent pitch mark, and the distance and difference loaded by the first and second loading means.

In order to achieve the above object, a control method for a speech synthesis apparatus according to the present invention has the following steps.

There is provided a control method for a speech synthesis apparatus for performing speech synthesis by using pitch marks, comprising:

a first calculation step of calculating the distance between first two pitch marks of a voiced portion of speech data to be processed;

a second calculation step of calculating the difference between adjacent inter-pitch-mark distances; and a management step of storing the calculation results obtained in the first and second calculation steps in a file and managing the results.

In order to achieve the above object, a control method for a speech synthesis apparatus according to the present invention has the following steps.

There is provided a control method for a speech synthesis apparatus for performing speech synthesis by sing pitch marks, comprising:

a first comparison step of, when the length of speech data to be processed is represented by d, and the maximum value dmax and a minimum value dmin are defined for a predetermined word length, comparing the length d with the maximum value dmax;

a second comparison step of comparing the length d with the minimum value dmin on the basis of the comparison result obtained in the first comparing step;

a subtraction step of subtracting the maximum value dmax or the minimum value dmin from the length d on the basis of the comparison results obtained in the first and second comparison steps; and a management step of storing the difference obtained in the subtraction step or the length d in the file and managing the difference or the length on the basis of the comparison results obtained in the first and second comparison steps.

In order to achieve the above object, a control method for a speech synthesis apparatus according to the present invention has the following steps.

There is provided a control method for a speech synthesis apparatus for performing speech synthesis by using pitch marks, comprising:

a storage step of storing a file for managing the distance between the first two pitch marks of a voiced portion of speech data to be processed and the difference between adjacent inter-pitch-mark distances;

a first loading step of loading the distance between the first two pitch marks of the voiced portion;

a second loading step of loading the difference between the adjacent inter-pitch-mark distances; and a calculation step of calculating a next pitch mark position from a pitch mark position calculated immediately before the calculation, a pitch mark distance to an adjacent pitch mark, and the distance and difference loaded in the first and second loading steps.

In order to achieve the above object, a computer-readable memory according to the present invention has the following program codes.

There is provided a computer-readable memory storing program codes for controlling a speech synthesis apparatus for performing speech synthesis by using pitch marks, comprising:

a program code for the first calculation step of calculating the distance between the first two pitch marks of a voiced portion of speech data to be processed;

a program code for the second calculation step of calculating the difference between adjacent inter-pitch-mark distances; and a program code for the management step of storing he calculation results obtained in the first and second calculation steps in a file and managing the results.

In order to achieve the above object, a computer-readable memory according to the present invention has the following program codes.

There is provided a computer-readable memory storing program codes for controlling a speech synthesis apparatus for performing speech synthesis by using pitch marks, comprising:

a program code for the first comparison step of, when the length of speech data to be processed is represented by d, and the maximum value dmax and a minimum value dmin are defined for a predetermined word length, comparing the length d with the maximum value dmax;

a program code for the second comparison step of comparing the length d with the minimum value dmin on the basis of the comparison result obtained in the first comparing step;

a program code for the subtraction step of subtracting the maximum value dmax or the minimum value dmin from the length d on the basis of the comparison results obtained in the first and second comparison steps; and a program code for the management step of storing the difference obtained in the subtraction step or the length d in the file and managing the difference or the length on the basis of the comparison results obtained in the first and second comparison steps.

In order to achieve the above object, a computer-readable memory according to the present invention has the following program codes.

There is provided a computer-readable memory storing program codes for controlling a speech synthesis apparatus for performing speech synthesis by using pitch marks, comprising:

a program code for the storage step of storing a file for managing the distance between the first two pitch marks of a voiced portion of speech data to be processed and the difference between adjacent inter-pitch-mark distances;

a program code for the first loading step of loading the distance between the first two pitch marks of the voiced portion;

a program code for the second loading step of loading the difference between the adjacent inter-pitch-mark distances; and a program code for the calculation step of calculating a next pitch mark position from a pitch mark position calculated immediately before the calculation, a pitch mark distance to an adjacent pitch mark, and the distance and difference loaded in the first and second loading steps.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

First Embodiment

Figure 1:
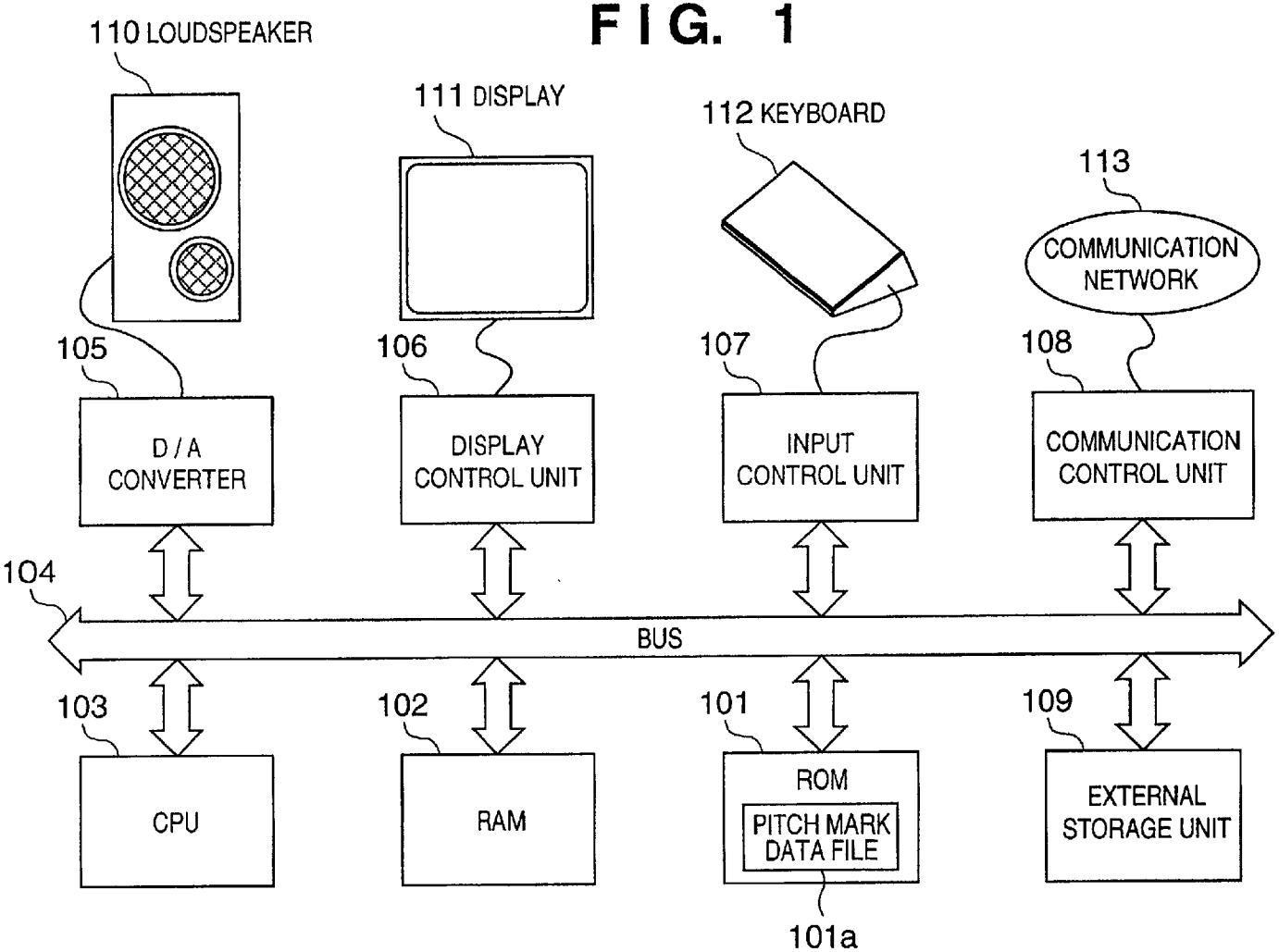
FIG. 1 is a block diagram showing the arrangement of a speech synthesis apparatus according to the first embodiment of the present invention.

FIG. 1 is a block diagram showing the arrangement of a speech synthesis apparatus according to the first embodiment of the present invention.

Reference numeral 103 denotes a CPU for performing numerical operation/control, control on the respective components of the apparatus, and the like, which are executed in the present invention; 102 denotes a RAM serving as a work area for processing executed in the present invention, a temporary saving area for various data and having an area for storing a pitch-mark-data file 101*a*; 101 denotes a ROM storing various control programs such as programs executed in the present invention, for managing pitch-mark data used for speech synthesis; 109 denotes an external storage unit serving as an area for storing processed data; and 105 denotes a D/A converter for converting the digital speech data synthesized by the speech synthesis apparatus into analog speech data and outputting it from a loudspeaker 110.

Reference numeral 106 denotes a display control unit for controlling a display 111 when the processing state and processing results of the speech synthesis apparatus, and a user interface are to be displayed; 107 denotes an input control unit for recognizing key information input from a keyboard 112 and executing the designated processing; 108 denotes a communication control unit for controlling transmission/reception of data through a communication network 113; and 104 denotes a bus for connecting the respective components of the speech synthesis apparatus to each other.

Pitch-mark-data, file-generation processing executed in the first embodiment will be described next with reference to FIG. 2.

Figure 2:
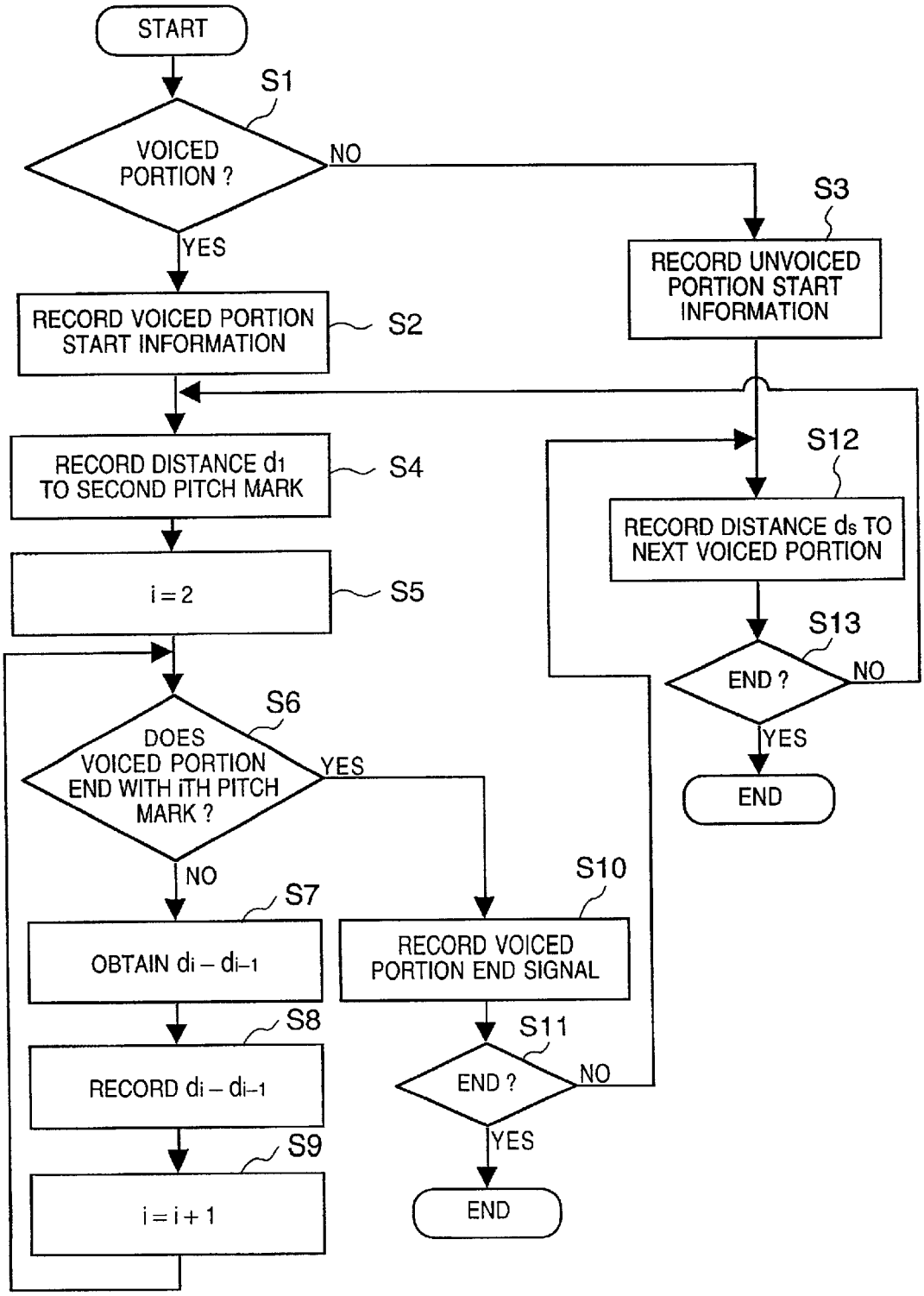
FIG. 2 is a flow chart showing pitch-mark-data, file-generation processing executed in the first embodiment of the present invention.

FIG. 2 is a flow chart showing pitch-mark-data, file generation processing executed in the first embodiment of the present invention.

Figure 3:
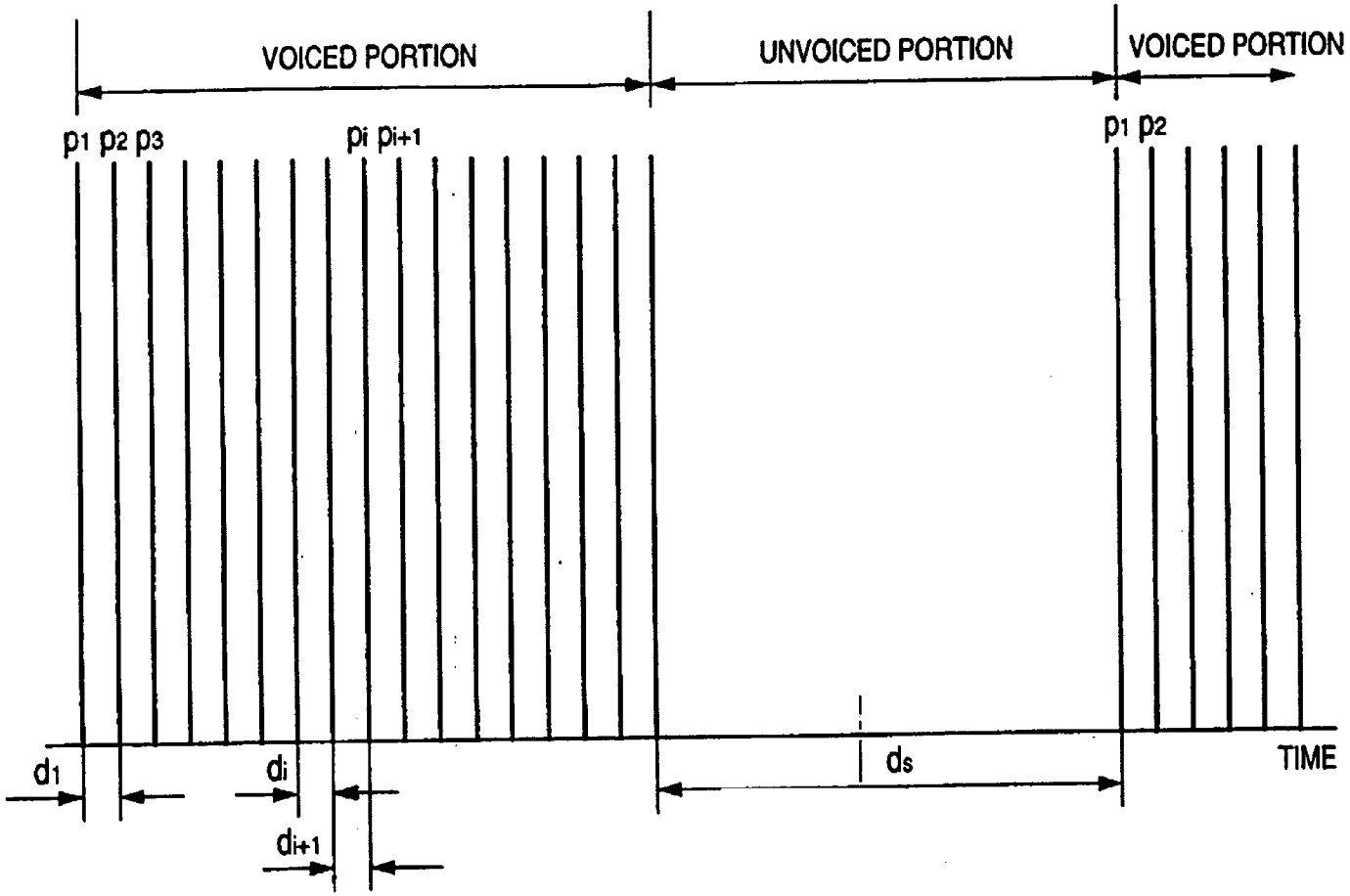
FIG. 3 is a view for explaining pitch marks in the first embodiment of the present invention.

As shown in FIG. 3, pitch marks $p_1, p_2, \ldots, p_i, p_{i+1}$ are arranged in each voiced portion at certain intervals, but no pitch mark is present in any unvoiced portion.

First of all, it is checked in step S1 whether the first segment of speech data to be processed is a voiced or unvoiced portion. If it is determined that the first segment is a voiced portion (YES in step S1), the flow advances to step S2. If it is determined that the first segment is an unvoiced portion (NO in step S1), the flow advances to step S3.

In step S2, voiced portion start information indicating that "the first segment is a voiced portion" is recorded. In step S4, a first inter-pitch-mark distance (distance between the first pitch mark $p_1$ and the second pitch mark $p_2$ of the voiced portion) $d_1$ is recorded in the pitch mark data file 101*a*. In step S5, the value of a loop counter i is initialized to 2.

It is then checked in step S6 whether the voiced portion ends with the ith pitch mark $p_i$ indicated by the value of the loop counter i. If it is determined that the voiced portion does not end with the pitch mark $p_i$ (NO in step S6), the flow advances to step S7 to obtain the difference $(d_i-d_{i-1})$ between an inter-pitch-mark distance $d_i$ and an inter-pitch-mark distance $d_{i-1}$. In step S8, the obtained difference $(d_i-d_{i-1})$ is recorded in the pitch mark data file 101*a*. In step S9, the loop counter i is incremented by 1, and the flow returns to step S6.

If it is determined that the voiced portion ends (YES in step S6), the flow advances to step S10 to record a voiced portion end signal indicating the end of the voiced portion in the pitch-mark-data file 101*a*. Note that any signal can be used as the voiced portion end signal as long as it can be discriminated from an inter-pitch-mark distance. In step S11, it is checked whether the speech data has ended. If it is determined that the speech data has not ended (NO in step S11), the flow advances to step S12. If it is determined that the speech data has ended (YES in step S11), the processing is terminated. flow advances to step S12. If it is determined that the speech data has ended (YES in step S11), the processing is terminated.

It is determined in step S1 that the first segment of the speech data is an unvoiced portion (NO in step S1), the flow advances to step S3 to record unvoiced portion start information indicating that "the first segment is an unvoiced portion" in the pitch mark data file 101*a*. In step S12, the distance d, between the voiced portion and the next voiced portion (i.e., the length of the unvoiced portion) is recorded in the pitch mark data file 101*a*. In step S13, it is checked whether the speech data has ended. If it is determined that the speech data has not ended (NO in step S13), the flow advances to step S4. If it is determined that the speech data has ended (YES in step S13), the processing is terminated.

As described above, according to the first embodiment, since the respective pitch marks in each voiced portion are managed by using the distances between the adjacent pitch marks, all the pitch marks in each voiced portion need not be managed. This can reduce the size of the pitch-mark-data file 101*a*.

Figure 4:
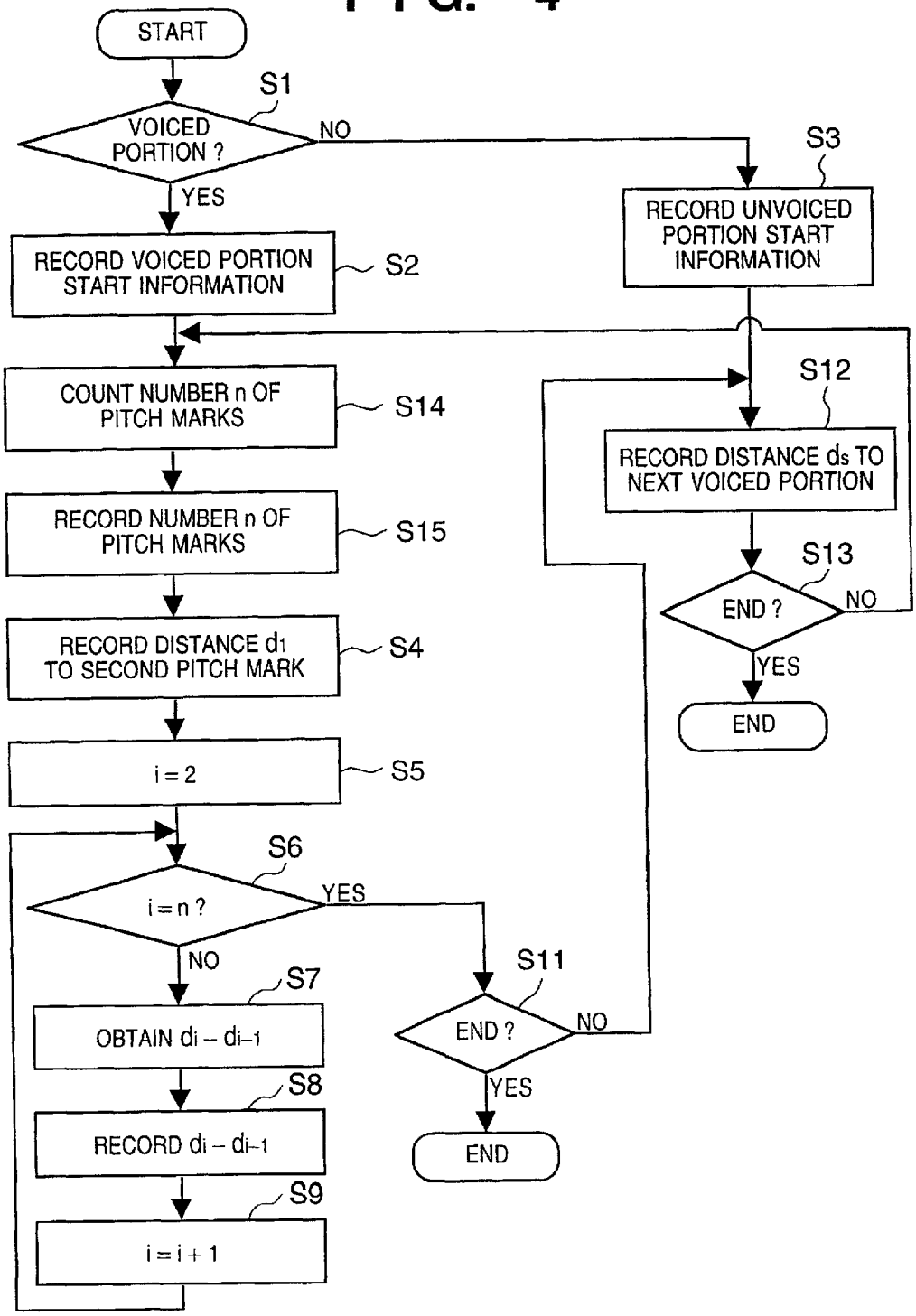
FIG. 4 is a flow chart showing another example of the pitch mark data file generation processing executed in the first embodiment of the present invention.

In the first embodiment, step S10 may be replaced with step S14 of counting the number (n) of pitch marks in each voiced portion and step S15 of recording the counted number n of pitch marks in the pitch-mark-data file 101*a*, as shown in FIG. 4. In this case, the processing in step S6 amounts to checking whether the value of the loop counter i is equal to the number n of pitch marks.

Another example of the processing of recording pitch marks of each voiced portion in the first embodiment will be described with reference to FIG. 5.

Figure 5:
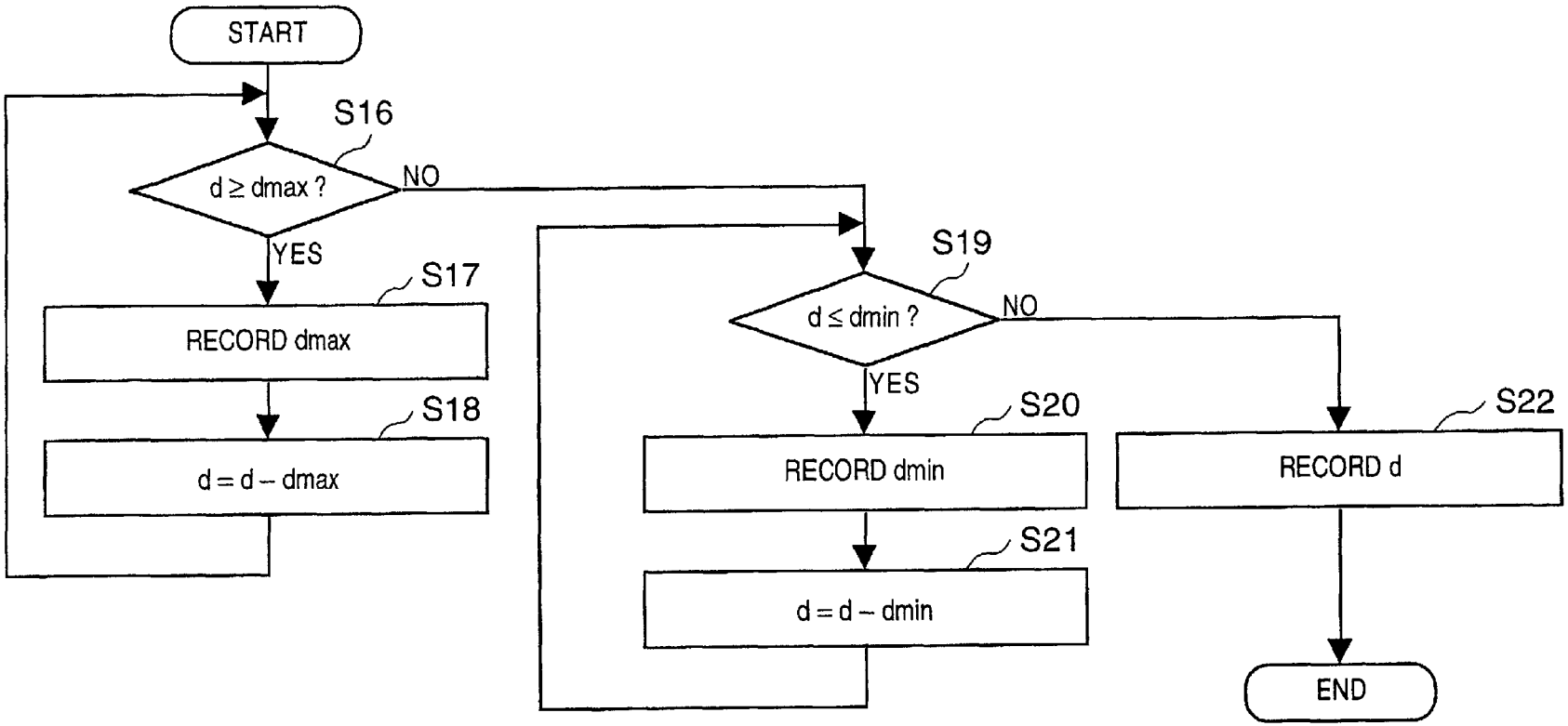
FIG. 5 is a flow chart showing another example of the processing of recording the pitch marks of a voiced portion in the first embodiment of the present invention.

FIG. 5 is a flow chart showing another example of the processing of recording pitch marks of each voiced portion in the first embodiment of the present invention.

For example, the data length of speech data to be processed is represented by d, and a maximum value dmax (e.g., 127) and a minimum value dmin (e.g., −127) are defined for a given word length (e.g., 8 bits).

First of all, in step S16, d is compared with dmax. If d is equal to or larger than dmax (YES in step S16), the flow advances to step S17 to record the maximum value dmax in the pitch-mark-data file 101*a*. In step S18, dmax is subtracted from d, and the flow returns to step S16. If it is determined that d is smaller than dmax (NO in step S16), the flow advances to step S19.

In step S19, d is compared with dmin. If d is equal to or smaller than dmin (YES in step S19), the flow advances to step S20 to record the minimum value dmin in the pitch mark data file 101*a*. In step S21, dmin is subtracted from d, and the flow returns to step S19. If it is determined that d is larger than dmin (NO in step S19), the flow advances to step S22 to record d. The processing is then terminated.

With this recording, for example, dmin−1 (−128 in the above case) can be used as a voiced portion end signal.

Second Embodiment

In the second embodiment, pitch-mark-data-file loading processing of loading data from the pitch-mark-data file 101*a* recorded in the first embodiment will be described with reference to FIG. 6.

Figure 6:
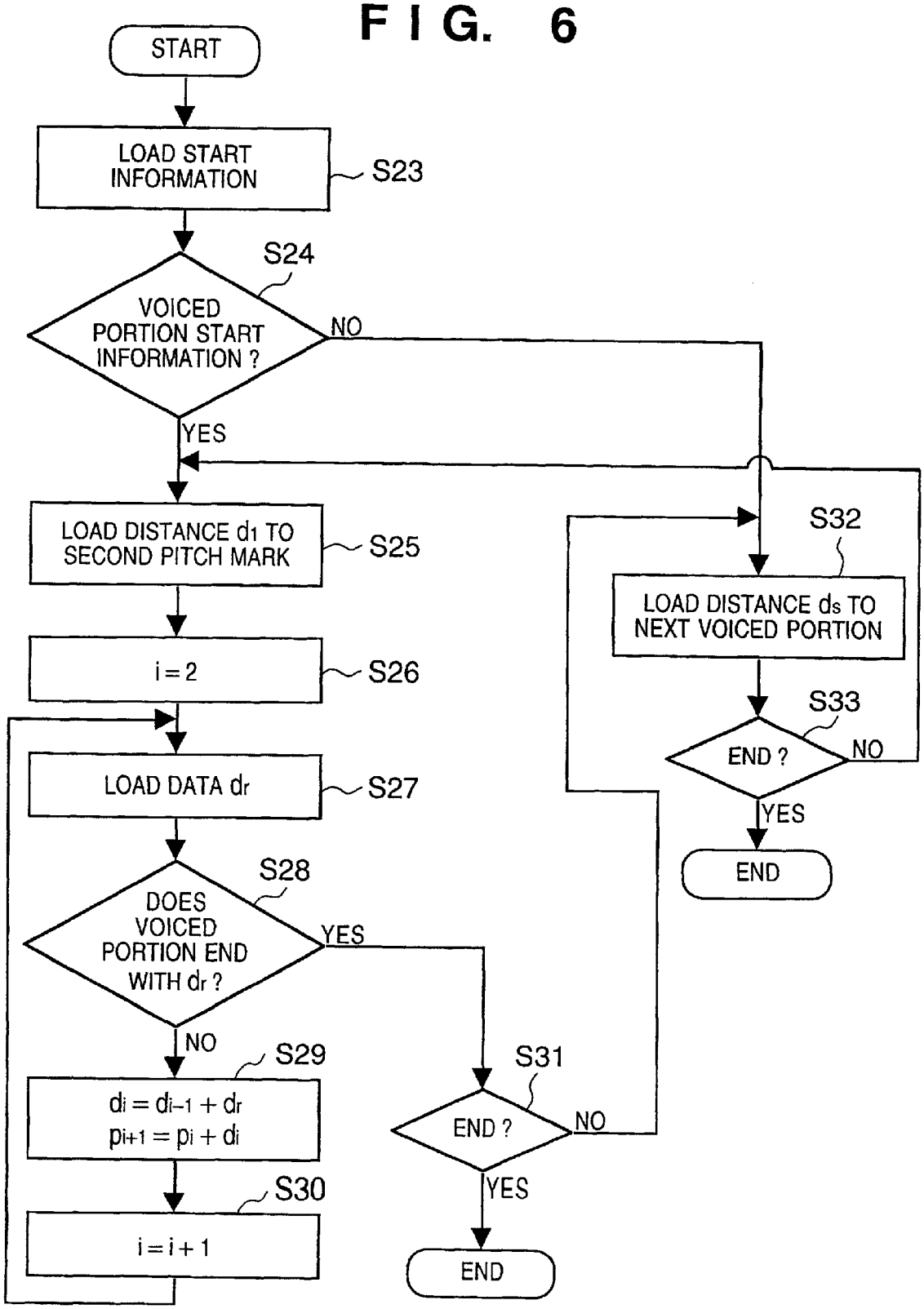
FIG. 6 is a flow chart showing pitch-mark-data, file-loading processing executed in the second embodiment of the present invention.

FIG. 6 is a flow chart showing pitch-mark-data-file loading processing executed in the second embodiment of the present invention.

First of all, in step S23, start information indicating whether the start of speech data to be processed is a voice or unvoiced portion, is loaded from a pitch-mark-data file 101*a*. It is then checked in step S24 whether the loaded start information is voiced portion start information. If voiced portion start information is determined (YES in step S24), the flow advances to step S25 to load a first inter-pitch-mark distance (distance between a first pitch mark $p_1$ and a second pitch mark $p_2$ of the voiced portion) $d_1$ from the pitch mark data file 101*a*. Note that the second pitch mark $p_2$ is located at $p_1+d_1$.

In step S26, the value of a loop counter i is initialized to 2. In step S27, a difference $d_r$ (data corresponding the length of one word) from the pitch-mark-data file 101*a*. In step S28, it is checked whether the loaded difference $d_r$ is a voiced portion end signal. If it is determined that the difference is not a voiced portion end signal (NO in step S28), the flow advances to step S29 to calculate the next inter-pitch-mark distance $d_i$ and the pitch mark position $p_{i+1}$ from a pitch mark position $p_i$, the inter-pitch-mark distance $d_{i-1}$ and $d_r$ obtained in the past.

The following equations can be formulated from $p_i$, $d_{i-1}$, $d_r$, $d_i$, and $p_{i+1}$. The next inter-pitch-mark distance $d_i$ and the pitch mark position $p_{i+1}$, can be calculated by using these equations.

$$d_i = d_{i-1} + d_r \quad (1)$$

$$p_{i+1} = p_i + d_i \quad (2)$$

In step S30, the loop counter i is incremented by 1. The flow then returns to step S27.

If it is determined that dr is a voiced portion end signal (YES in step S28), the flow advances to step S31 to check whether the speech data has ended. If it is determined that the speech data has not ended (NO in step S31), the flow advances to step S32. If it is determined that the speech data has ended (YES in step S31), the processing is terminated.

If it is determined in step S24 that the loaded information is not voiced portion start information (NO in step S24), the flow advances to step S32 to load a distance $d_s$ to the next voiced portion from the pitch mark data file 101*a*. It is then checked in step S33 whether the speech data has ended. If it is determined that the speech data has not ended (NO in step S33), the flow advances to step S25. If it is determined that the speech data has ended (YES in step S33), the processing is terminated.

As described above, according to the second embodiment, since pitch marks can be loaded by using the pitch-mark-data file 101*a* managed by the processing described in the first embodiment, the size of data to be processed decreases to improve processing efficiency.

Another example of the processing of loading pitch marks of each voiced portion in the second embodiment will be described with reference to FIG. 7.

Figure 7:
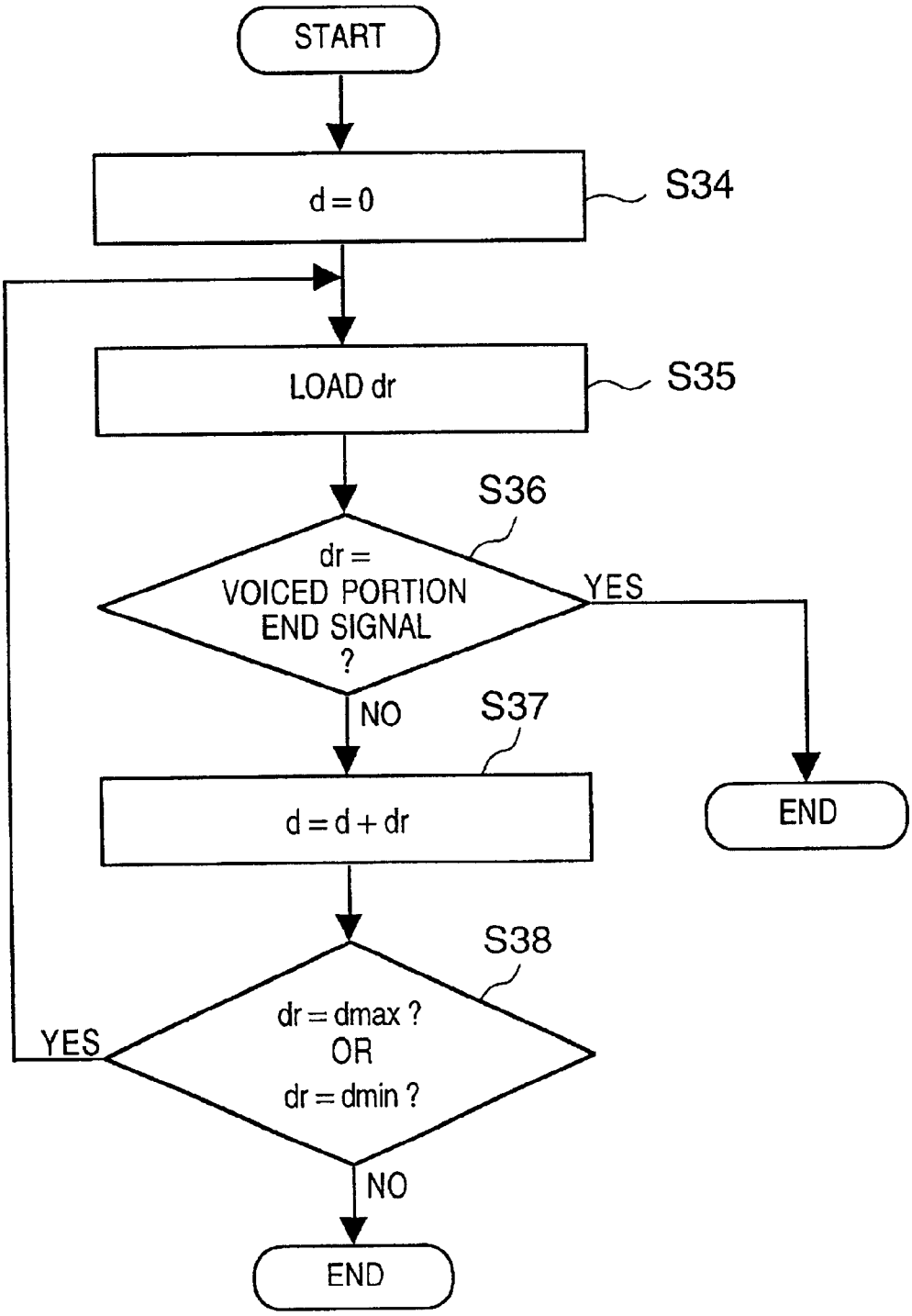
FIG. 7 is a flow chart showing another example of the processing of loading the pitch marks of a voiced portion in the second embodiment of the present invention.

FIG. 7 is a flow chart showing another example of the processing of loading pitch marks of each voiced portion in the second embodiment of the present invention.

Assume that the data-length information of loaded speech data is stored in a register d, and a maximum value dmax (e.g., 127), a minimum value dmin (e.g, −127), and a voiced portion end signal are defined for a given word length (e.g., 8 bits) in FIG. 5. and a voiced portion end signal are defined for a given word length (e.g., 8 bits) in FIG. 5.

First of all, in step S34, the register d is initialized to 0. In step S35, the data $d_r$ corresponding to the length of one word is loaded from the pitch-mark-data file 101*a*. It is then checked in step S36 whether $d_r$ is a voiced portion end signal. If it is determined that the $d_r$ is a voiced portion end signal (YES in step S36), the processing is terminated. If it is determined that $d_r$ is not a voiced portion end signal (NO in step S36), the flow advances to step S37 to add $d_r$ to the contents of the register d.

In step S38, it is checked whether $d_r$ is equal to dmax or dmin. If it is determined that they are equal (YES in step S38), the flow returns to step S35. If it is determined that they are not equal (NO in step S38), the processing is terminated.

Note that the present invention may be applied to either a system constituted by a plurality of pieces of equipments (e.g., a host computer, an interface device, a reader, a printer, and the like), or an apparatus consisting of a single piece of equipment (e.g., a copying machine, a facsimile apparatus, or the like).

The objects of the present invention are also achieved by supplying a storage medium, which records a program code of a software program that can realize the functions of the above-mentioned embodiments to the system or apparatus, and reading out and executing the program code stored in the storage medium by a computer (or a CPU or MPU) of the system or apparatus.

In this case, the program code itself read out from the storage medium realizes the functions of the above-mentioned embodiments, and the storage medium which stores the program code constitutes the present invention.

As the storage medium for supplying the program code, for example, a floppy disk, hard disk, optical disk, magneto-optical disk, CD-ROM, CD-R, magnetic tape, nonvolatile memory card, ROM, and the like may be used.

The functions of the above-mentioned embodiments may be realized not only by executing the readout program code by the computer but also by some or all of actual processing operations executed by an OS (operating system) running on the computer on the basis of an instruction of the program code.

Furthermore, the functions of the above-mentioned embodiments may be realized by some or all of actual processing operations executed by a CPU or the like arranged in a function extension board or a function extension unit, which is inserted in or connected to the computer, after the program code read out from the storage medium is written in a memory of the extension board or unit.

As many apparently widely different embodiments of the present invention can be made without departing from the spirit and scope thereof, it is to be understood that the invention is not limited to the specific embodiments thereof except as defined in the appended claims.

What is claimed is:

1. A speech synthesis control apparatus for storing and managing pitch mark data files for use in performing speech synthesis by using pitch marks, comprising:

recording means for recording an inter-pitch-mark distance between the first two pitch marks of a voiced portion of speech data to be processed;

calculation means for calculating a difference between adjacent inter-pitch-mark distances, which are obtained by calculating distances between adjacent pitch-mark position; and management means for recording the calculation results obtained by said calculation means in a file and managing the results;

wherein said management means further calculates an inter-voiced-portion distance as a distance between voiced portions on both sides of an unvoiced portion, stores the distance in the file, and manages the distance.

2. The apparatus according to claim 1, further comprising counting means for counting the number of pitch marks of the voiced portion, and when the number of pitch marks is counted by said counting means, said management means stores the number of pitch marks in the file and manages the number of pitch marks.

3. A speech synthesis apparatus for performing speech synthesis by using pitch marks, comprising:

first comparison means for, when a length of speech data to be processed is represented by d, and a maximum value dmax and a minimum value dmin are defined for a predetermined word length, comparing the length d with the maximum value dmax;

second comparison means for comparing the length d with the minimum value dmin on the basis of the comparison result obtained by said first comparing means;

subtraction means for subtracting the maximum value dmax or minimum value dmin from the length d on the basis of the comparison results obtained by said first and second comparison means; and management means for storing the difference obtained by said subtraction means or the length d in the file and managing the difference or the length on the basis of the comparison results obtained by said first and second comparison means.

4. The apparatus according to claim 3, wherein said subtraction means subtracts the maximum value dmax from the length d when the comparison result obtained by said first comparison means indicates that the length d is not less than the maximum value dmax, and subtracts the minimum value dmin from the length d when the comparison result obtained by said second comparison means indicates that the length d is not more than the minimum value dmin.

5. A speech synthesis apparatus for performing speech synthesis by using pitch marks, comprising:

storage means for storing a file for managing an inter-pitch-mark distance between the first two pitch marks of a voiced portion of speech data to be processed and a difference between adjacent inter-pitch-mark distances;

first loading means for loading the inter-pitch-mark distance between the first two pitch marks of the voiced portion;

second loading means for loading the difference between the adjacent inter-pitch-mark distances; and calculation means for calculating a next pitch mark position from a pitch mark position calculated immediately before the calculation, a pitch mark distance to an adjacent pitch mark, and the distance and difference loaded by said first and second loading means.

6. The apparatus according to claim 5, wherein in the file stored in said storage means, a distance between voiced portions on both sides of an unvoiced portion is managed, and said calculation means loads the distance between the voiced portions on both sides of the unvoiced portion when processing is to be performed for the next voiced portion.

7. The apparatus according to claim 5, wherein when a data length of data to be processed is held, and a maximum value dmax and a minimum value dmin are defined for a predetermined word length, fixed-length data $d_r$ is also managed in the file stored in said storage means, and it is checked whether a value obtained by loading the fixed-length data $d_r$ and adding d to the data $d_r$ is equal to the maximum value dmax or the minimum value dmin, and the fixed-length data $d_r$ is loaded when the value is equal to the maximum value dmax or the minimum value dmin.

8. A control method for a speech synthesis control apparatus for storing and managing pitch mark data files in performing speech synthesis by using pitch marks, comprising:

a recording step for recording an inter-pitch-mark distance between the first two pitch marks of a voiced portion of speech data to be processed;

a calculation step for calculating a difference between adjacent inter-pitch-mark distances, which are obtained by calculating distances between adjacent pitch-mark positions; and a management step for recording the calculation results obtained in said calculation step in a file and managing the results, wherein said management step further comprises calculating an inter-voiced-portion distance as a distance between voiced portions on both sides of an unvoiced portion, storing the distance in the file, and managing the distance.

9. The method according to claim 8, further comprising a counting step of counting the number of pitch marks of the voiced portion, and when the number of pitch marks is counted in said counting step, said management step stores the number of pitch marks in the file and manages the number of pitch marks.

10. A control method for a speech synthesis apparatus for performing speech synthesis by using pitch marks, comprising:

a first comparison step of, when a length of speech data to be processed is represented by d, and a maximum value dmax and a minimum value dmin are defined for a predetermined word length, comparing the length d with the maximum value dmax;

a second comparison step of comparing the length d with the minimum value dmin on the basis of the comparison result obtained in said first comparing step;

a subtraction step of subtracting the maximum value dmax or minimum value dmin from the length d on the basis of the comparison results obtained in said first and second comparison steps; and a management step of storing the difference obtained in the subtraction step or the length d in the file and managing the difference or the length on the basis of the comparison results obtained in said first and second comparison steps.

11. The method according to claim 10, wherein said subtraction step comprises subtracting the maximum value dmax from the length d when the comparison result obtained in said first comparison step indicates that the length d is not less than the maximum value dmax, and subtracting the minimum value dmin from the length d when the comparison result obtained in said second comparison step indicates that the length d is not more than the minimum value dmin.

12. A control method for a speech synthesis apparatus for performing speech synthesis by using pitch marks, comprising:

a storage step of storing a file for managing a distance between first two pitch marks of a voiced portion of speech data to be processed and a difference between adjacent inter-pitch-mark distances;

a first loading step of loading the distance between the first two pitch marks of the voiced portion;

a second loading step of loading the difference between the adjacent inter-pitch-mark distances; and a calculation step of calculating a next pitch mark position from a pitch mark position calculated immediately before the calculation, a pitch mark distance to an adjacent pitch mark, and the distance and difference loaded in said first and second loading steps.

13. The method according to claim 12, wherein in the file stored in said storage step, a distance between voiced portions on both sides of an unvoiced portion is managed, and a calculation step comprises loading the distance between the voiced portions on both sides of the unvoiced portion when processing is to be performed for the next voiced portion.

14. The method according to claim 12, wherein fixed-length data $d_r$ in the file stored in said storage step when a data length of data to be processed is held, and a maximum value dmax and a minimum value dmin are defined for a predetermined word length, and a step of checking whether a value obtained by loading the fixed-length data $d_r$ and adding d to the data $d_r$ is equal to the maximum value dmax or the minimum value dmin, and loading the fixed-length data $d_r$ when the value is equal to the maximum value dmax or the minimum value dmin.

15. A computer-readable memory storing program codes for controlling a speech synthesis control apparatus for storing and managing pitch mark data files for use in performing speech synthesis by using pitch marks, comprising:

a program code for recording an inter-pitch-mark distance between first two pitch marks of a voiced portion of speech data to be processed;

a program code for calculating a difference between adjacent inter-pitch-mark distances, which are obtained by calculating distance between adjacent pitch-mark positions;

a program code for recording calculation results obtained by the calculating program code in a file and managing the calculation results; and a program code for calculating an inter-voiced-portion distance as a distance between voiced portions on both sides of an unvoiced portion, storing the distance in the file, and managing the distance.

16. A computer-readable memory storing program codes for controlling a speech synthesis apparatus for performing speech synthesis by using pitch marks, comprising:

a program code for the first comparison step of, when a length of speech data to be processed is represented by d, and a maximum value dmax and a minimum value dmin are defined for a predetermined word length, comparing the length d with the maximum value dmax;

a program code for the second comparison step of comparing the length d with the minimum value dmin on the basis of the comparison result obtained in said first comparing step;

a program code for the subtraction step of subtracting the maximum value dmax or minimum value dmin from the length d on the basis of the comparison results obtained in said first and second comparison steps; and a program code for the management step of storing the difference obtained in the subtraction step or the length d in the file and managing the difference or the length on the basis of the comparison results obtained in said first and second comparison steps.

17. A computer-readable memory storing program codes for controlling a speech synthesis apparatus for performing speech synthesis by using pitch marks, comprising:

a program code for the storage step of storing a file for managing a distance between first two pitch marks of a voiced portion of speech data to be processed and a difference between adjacent inter-pitch-mark distances;

a program code for the first loading step of loading the distance between the first two pitch marks of the voiced portion;

a program code for the second loading step of loading the difference between the adjacent inter-pitch-mark distances; and a program code for the calculation step of calculating a next pitch mark position from a pitch mark position calculated immediately before the calculation, a pitch mark distance to an adjacent pitch mark, and the distance and difference loaded in said first and second loading steps.

* * * * *

UNITED STATES PATENT AND TRADEMARK OFFICE

CERTIFICATE OF CORRECTION

PATENT NO. : 7,054,806 B1
APPLICATION NO. : 09/262852
DATED : May 30, 2006
INVENTOR(S) : Masayuki Yamada It is certified that error appears in the above-identified patent and that said Letters Patent is hereby corrected as shown below:

COLUMN 7
Line 35, "and a voiced portion end signal are defined" should be deleted.
Line 36 should be deleted.

COLUMN 8
Line 33, "position;" should read --positions;--.

COLUMN 9
Line 22, "from a" should read --based on a previously calculated--, and "positon calculated immediately" should read --position,--.
Line 23, "before the calculation," should be deleted.

Signed and Sealed this

Seventeenth Day of April, 2007

JON W. DUDAS
*Director of the United States Patent and Trademark Office*